US005505350A

United States Patent [19]

Migliorini

[11] Patent Number: 5,505,350

[45] Date of Patent: Apr. 9, 1996

[54] METHOD AND APPARATUS FOR DISPOSING TWO TUBULAR ARTICLES IN A PREDETERMINED POSITION ON A CORRESPONDING SUPPORT

[75] Inventor: Pier L. Migliorini, Terranuova Bracciolini - Arezzo, Italy

[73] Assignee: Solis S.r.l., Tavarnuzze, Italy

[21] Appl. No.: 259,510

[22] Filed: Jun. 14, 1994

[30] Foreign Application Priority Data

Jun. 25, 1993 [IT] Italy ..... FI93A0121

[51] Int. Cl.[6] ..... D06C 5/00; A47G 25/90

[52] U.S. Cl. ..... 223/75; 223/112

[58] Field of Search ..... 223/75, 76, 77, 223/111, 112; 112/121.12, 121.15

[56] References Cited

U.S. PATENT DOCUMENTS 4,451,351 9/1985 Horita et al. ..... 112/121.15
4,611,733 9/1986 Nishikawa et al. ..... 223/75
5,014,634 5/1991 Hodges et al. ..... 223/112
5,058,516 10/1991 Maegawa et al. ..... 223/112

FOREIGN PATENT DOCUMENTS

FI/92/A/67 3/1992 Italy .
312410 11/1989 Japan .

*Primary Examiner*—C. D. Crowder
*Assistant Examiner*—Bibhu Mohanty
*Attorney, Agent, or Firm*—McGlew and Tuttle

[57] ABSTRACT

Apparatus for disposing two tubular articles in a predetermined position on corresponding paired support shapes. Structure is provided for optically detecting the end provided with elastic hem of each article fitted on the respective support shapes. A pushing element is provided for vertically aligning the ends provided with elastic hems of the articles between them. Structure is provided for compressing and retaining the free end provided with hem of each article. The optical sensors, are alternately moved longitudinally to the shapes by a carriage alternately movable longitudinally in the said longitudinal directions.

10 Claims, 12 Drawing Sheets

METHOD AND APPARATUS FOR DISPOSING TWO TUBULAR ARTICLES IN A PREDETERMINED POSITION ON A CORRESPONDING SUPPORT

FIELD OF THE INVENTION

The present invention refers to a method and apparatus for disposing two tubular articles, especially stockings, in a predetermined position on a corresponding support.

BACKGROUND OF THE INVENTION

It is known that in many technical applications there is the need of orienting and placing tubular articles in a predetermined position to make them ready for a subsequent working operation. This problem is of special concern particularly in the stocking factories, as the stocking fabric is very thin and flexible and, accordingly, is unable to give the stockings a shape of their own. This occurs, for example, in the manufacturing of pantyhose articles, according to which two stockings fitted on a pair of superimposed coupled shapes must be first positioned with the respective elastic hems vertically aligned so as to have a correspondence between said elastic hems and the garter lines of the two stockings; afterwards, the stockings are cut longitudinally by starting from the elastic hem of the bodice, up to a predetermined distance from the garter line and, finally, they are sewn together along the thus cut edges. It goes without saying that in order to make the said cut with the necessary accuracy, it is necessary that the two stockings be properly positioned on the respective shapes, so as to provide a precise correspondence between the elastic hems and the garter lines and not to incur the serious drawback of making the seam with two stockings in offset relationship to each other and, thereby, manufacturing a pantyhose article with no wearability.

Also known from the Italian patent application FI92A67 of the same owner is an apparatus for automatically positioning two stockings in a machine for making pantyhose articles, in which the corresponding support shapes are extended in correspondence of the respective tips through an arc, that is a small bow of nylon thread and whose stems are moved along the shapes between two positions, one of maximum retreat, that is backwards movement, allowing the stocking to be fitted on the shapes, and the other of maximum extraction, that is drawing out movement, allowing both the bodice and the garter line resulting external to the shapes to be stretched, so as to allow the garter line to be sensed by corresponding optical sensors.

However, this known apparatus is unable to fully solve the problem relative to all types of tubular articles since it is intended to operate only on articles provided with a region of demarcation between two fabrics having different consistency, such as the garter line of a stocking, which separates the leg fabric and the bodice fabric.

It is further known from the Japanese document 1-312.410 an apparatus comprising:

optical sensors which detect the presence of two stockings on the respective shapes and are associated to corresponding first means for slidingly fitting the stockings on the shapes;

optical sensors, for detecting the garter line of the thus positioned stockings, and which are associated to corresponding means for transferring the portions of stockings with garter line to a predetermined position on the shapes;

optical sensors which detect the elastic hem of the stockings and are associated to corresponding second means for slidingly fitting the stockings on the shapes up to a predetermined final position.

This known apparatus provides, after placing the two stockings on the two paired shapes, for sensing the presence thereof, operating the activation of the first means for slidingly fitting the stockings deeply on the shapes and allowing the garter lines thereof to be intercepted by the relevant sensors. Thereafter, the same first stockings-sliding means provide for the alignment of the two garter lines. Finally, the sensors for the detection of the elastic hem of the two stockings place themselves in correspondence of the position of final alignment and the said second sliding means transfer the elastic hem of the two stockings up to the corresponding position for the final alignment thereof upon the shapes.

However, also this known apparatus makes it possible to operate only on articles provided with such a neat and well visible line of demarcation between two adjacent fabric regions having different consistency as a stocking's garter line.

SUMMARY AND OBJECTS OF THE INVENTION

The main object of the present invention is to provide a method and an apparatus allowing the correct positioning of tubular articles on corresponding support shapes, including the articles which are manufactured with a very elastic thread and/or are loaded on the respective shapes with the respective elastic hems being heavily inclined with respect to the axis of said shapes.

This result has been achieved, according to the invention, by adopting an operating method which, in the case of stocking manufacturing, comprises a preliminary step consisting in fitting the two stockings at random on a pair of coupled horizontal and superimposed flat shapes and, afterwards, the following further operating steps:

with the shapes being open, that is spaced apart, pushing each stocking, individually, towards the tip of the respective shapes, by acting, through push means, upon the horizontal upper edge of the elastic hem of the overlying stocking and, respectively, upon the horizontal lower edge of the elastic hem of the underlying stocking, along a direction parallel to the longitudinal axis of the shapes and at least up to a position of vertical alignment of the released edges, which position is determined, for each stocking, by optical detection means associated to said push means;

interrupting the advancement of said push means just beyond the position of completion of detection of the inner side of the last-to-intercept elastic hem;

reversing the motion of the push means and, upon interruption of the optical contact with the inner side of each elastic hem, compressing and holding the corresponding stocking at a position close to its elastic hem to allow it to be drawn towards the end of the shapes opposite to the tips, up to a predetermined point thereon;

closing the shapes, that is moving them together, so as to prevent the elastic return of the stockings to a position of misalignment of the respective elastic hems;

releasing the stockings from the support shapes, with the thus positioned and aligned free ends.

Advantageously, upon completion of the step of drawing the stocking onto the shapes, provision is made for slightly pushing the stockings towards the tip of the shapes to remove the elastic deformation of the stockings hems due to the friction taking place between the side portion of the stockings and the corresponding part of the shapes.

And for implementing the said method an apparatus is utilized which comprises:

means for detecting the presence of the free end of the article fitted on the respective flat support shapes by means of two vertically aligned optical sensors located juxtaposed on the side opposite to the shapes;

means for individually moving the free end of the articles onto the respective support shapes by means of a plurality of corresponding pushers parallel to the relevant optical sensor;

means for compressing a portion of each article on the relevant shape in correspondence of the free end thereof by means of two corresponding vertically aligned operating cylinders juxtaposed and located on opposite sides with respect to the shapes;

means for alternately moving the sensors, the pushers and the operating cylinders, in either directions longitudinally to the shapes, by means of a carriage alternately movable in the said directions starting from the end of the shapes opposite to the tip thereof.

The advantages deriving from the present invention lie essentially in that it is possible to position tubular articles on corresponding support shapes with rapidity and accuracy even when they are made of very elastic thread and provided or not with a particular reference line or region for corresponding optical detection means, which makes it possible to greatly simplify the step for positioning the articles and thus lowering the cost thereof; that it is possible to perform said positioning even by fitting the articles at random onto the respective shapes, that is, with the respective free ends however oriented or inclined to the direction orthogonal to the longitudinal axis of the same shapes; that an apparatus according to the invention is of simple fabrication, cost-effective and reliable even after a prolonged service life.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE PREFERRED EMBODIMENT

Figure 1A:
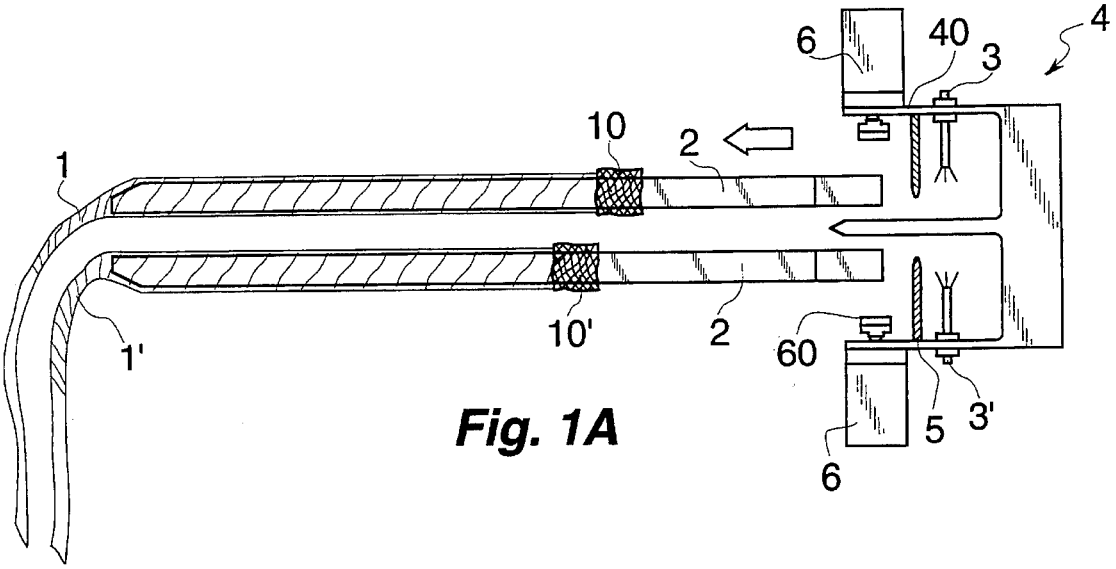
FIG. 1A is a longitudinal section view of an apparatus for positioning two stockings intended to form a pantyhose article, according to the invention, in the initial step of the work cycle, according to a first preferred embodiment.

Reduced to its basic structure, reference being made to the figures of the attached drawings, a method for disposing two stockings (1,1') in a predetermined position on respective supports (2), according to the invention, comprises a preliminary step consisting in fitting the two stockings (1,1') at random on a pair of coupled horizontal and superimposed flat shapes (2). Afterwards, in succession, the following further operating steps occur:

with the shapes being open pushing the free end provided with elastic hem (10) of the stocking (1) which results in it being fitted more deeply on the respective shape (2) towards the tip of the latter, by acting, through push means (5), on the outer edge of the elastic hem (10), in a direction parallel to the longitudinal axis of the shapes (2), so as to uncover and detect the inner end of the elastic hem (10') of the other stocking (1') of the pair, up to a position of vertical alignment of the released ends, which position is determined, for each stocking (1,1'), by optical detection means (3) associated to said push means (5);

interrupting the advancement of said push means (5) just beyond the position of completion of detection of the inner side of the last elastic hem (10') to be intercepted and detected;

reversing the motion of the stockings (1,1')-pushing means and, upon interruption of the optical contact with the inner side of each of said elastic hems (10,10'), compressing and holding the corresponding stocking (1,1'), at a position close to its elastic hem (10,10') to allow it to be drawn towards the end of the shapes (2)

which is opposite to the tips, in a direction parallel to the axis of the shapes (2) and up to a predetermined point on the latter;

closing, that is moving together, the shapes (2), so as to prevent the elastic return of the stockings to a position of misalignment of the respective elastic hems (10,10');

releasing the stockings (1,1') and leaving them on the support shapes, with the thus positioned and aligned free ends (10,10').

Advantageously, upon completion of the step of drawing the stockings on the shapes (2), provision is made for slightly pushing the stockings (1,1') towards the tip (20) of the shapes (2) to remove the elastic deformation of the stockings hems (10,10') due to the friction taking place between the side portion of the stockings (1,1') and the corresponding region of the shapes (2).

And for implementing the said method an apparatus is utilized which comprises:

means for detecting the end of the elastic hem (10,10') of each stocking (1,1') fitted on the respective support shapes (2), by means of two vertically aligned optical sensors (3,3') located juxtaposed on opposite sides with respect to the shapes (2) in correspondence of the vertical axial plane thereof;

means for vertically aligning between them the ends provided with elastic hems (10,10') of the stockings (1,1') by means of two pairs of pushers (5) disposed side-by-side, that is, along a line orthogonal to the axis of the shapes, said pushers being parallel to the relevant sensors (3,3') and located on opposite sides with respect to the shapes (2);

means for compressing and retaining the free end provided with elastic hem (10,10') of each stocking (1,1') by means of two vertically aligned operating cylinders (6) juxtaposed and located on opposite sides with respect to the shapes (2), each of which cylinders is provided with a pad (60) connected to the free end of its corresponding stem;

means for alternately moving in either of two directions the optical sensors (3,3'), pushers (5) and cylinders (6) longitudinally to the shapes (2) by means of a carriage (4), alternately movable in said longitudinal directions and which comprises a frame (40) with three horizontal brackets parallel to the shapes (2) and suitably spaced apart in vertical disposition, the two external ones being on opposite sides with respect to the shapes (2) and intended to support the said members (3) and (6) for the detection and respectively the capture of the stockings (1,1'), and the internal one being at a position intermediate to the shapes (2). The carriage (4) is located on the side of the shapes (2) opposite to the tips (20) thereof.

Figure 1B:
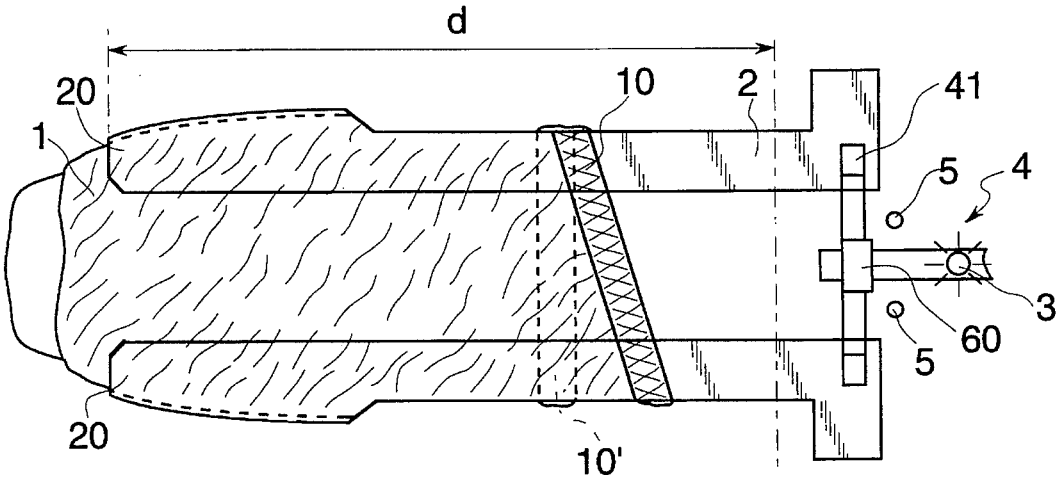
FIG. 1B is the plan view of the apparatus of FIG. 1A.
Figure 2A:
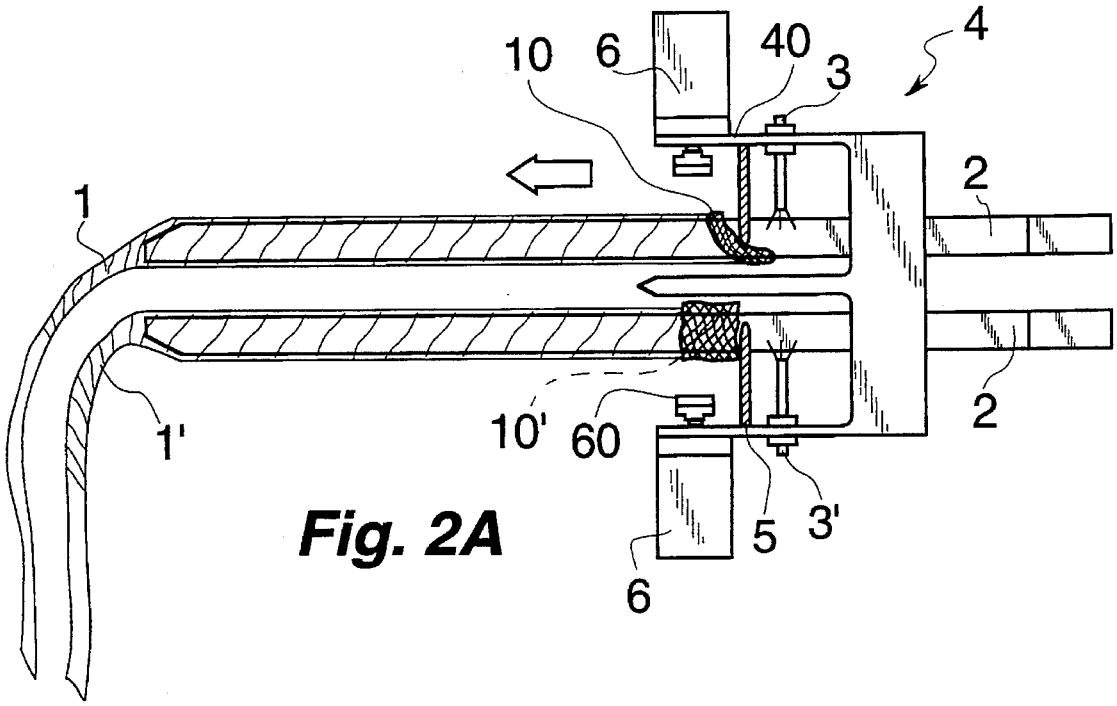
FIG. 2A shows the apparatus of FIG. 1A in the step of intercepting the free end provided with elastic hem of the upper stocking of the pair, that is, of the stocking which is more deeply fitted on the relevant shapes.
Figure 2B:
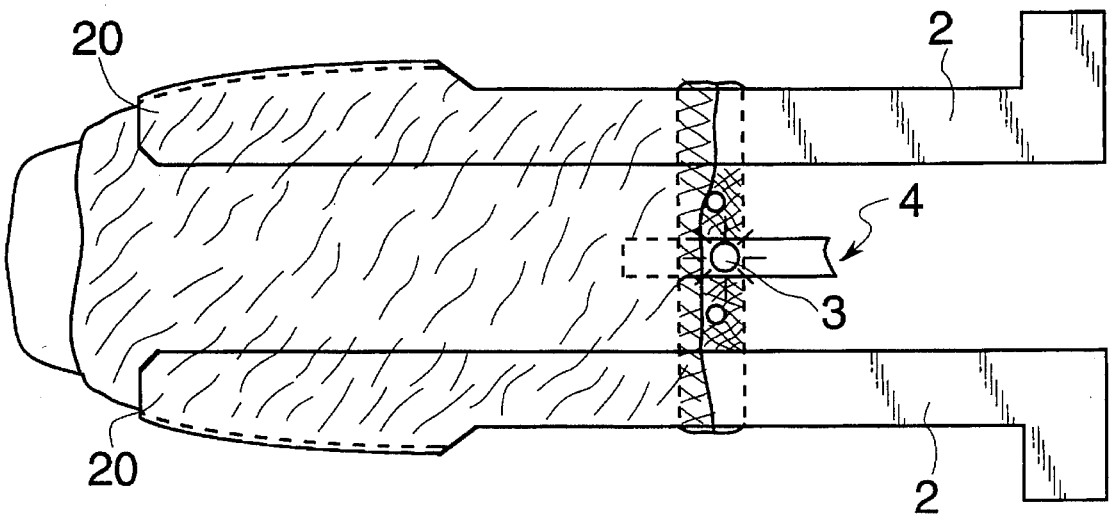
FIG. 2B is the plan view of the apparatus of FIG. 2A.
Figure 3B:
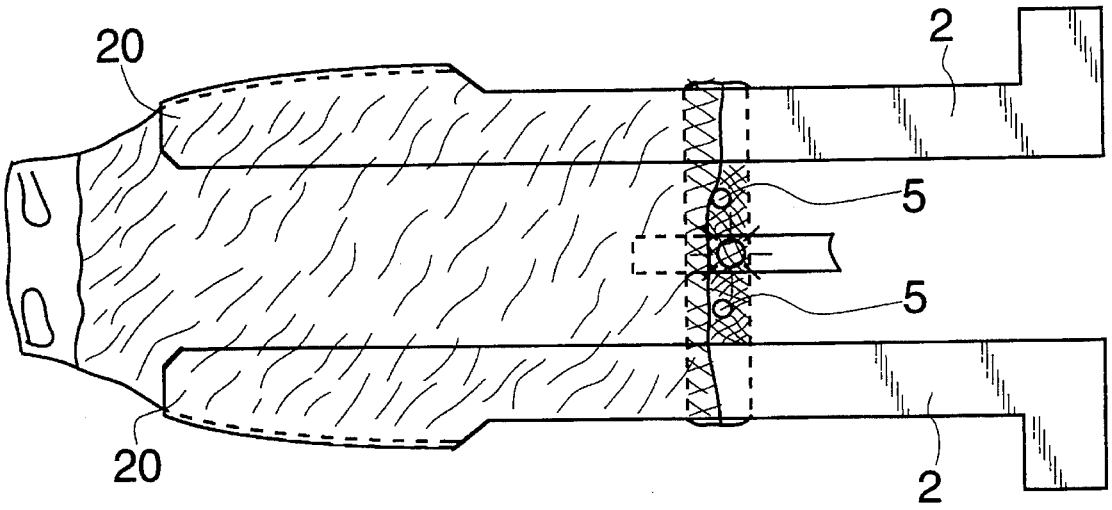
FIG. 3B is the plan view of the apparatus of FIG. 3A.
Figure 3A:
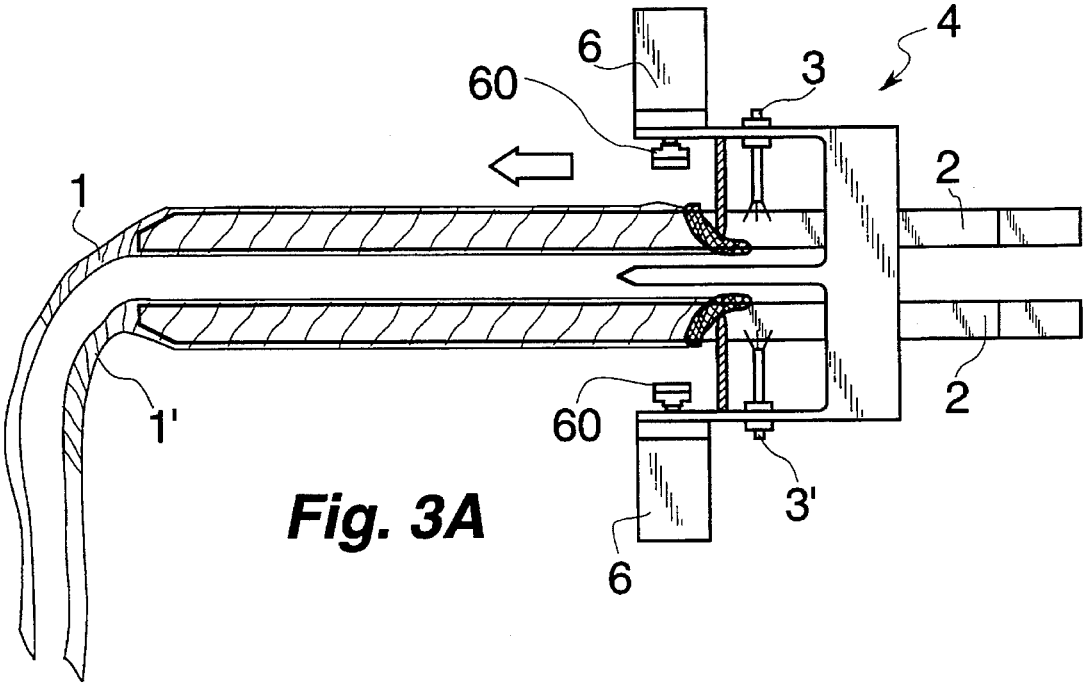
FIG. 3A shows the apparatus of FIG. 1A in the step of intercepting the free end provided with elastic hem of the lower stocking of the pair.
Figure 4A:
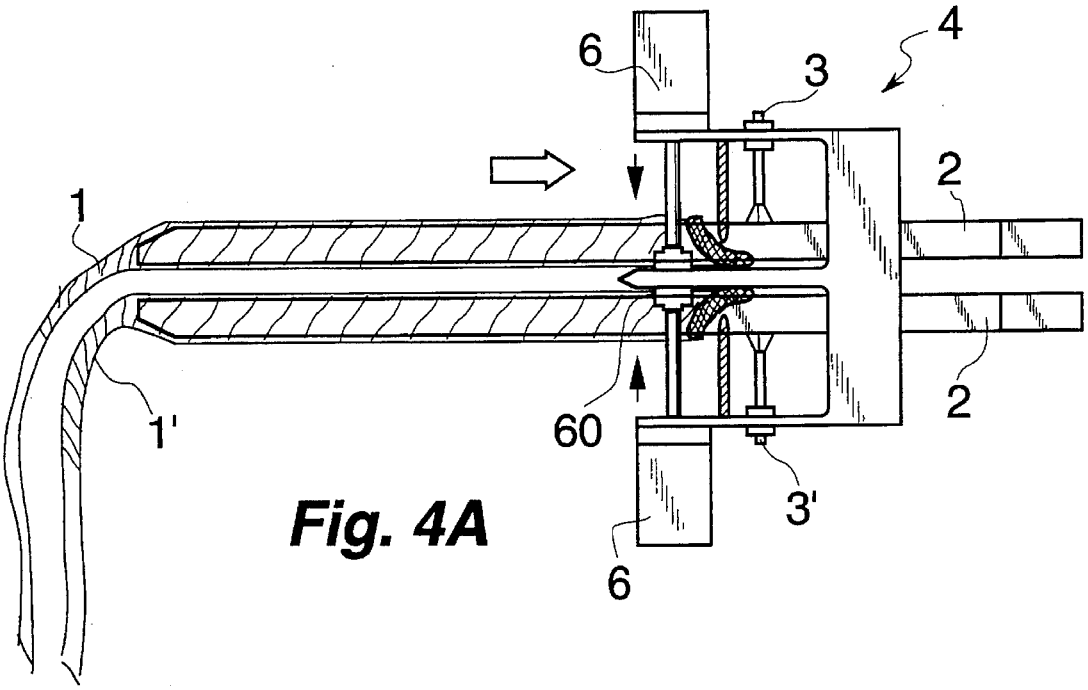
FIG. 4A shows the apparatus of FIG. 1A in the step of retaining the free end of the articles, in correspondence of the elestic hem, on the respective shapes, after which there will be the transfer thereof up to the final predetermined position.
Figure 4B:
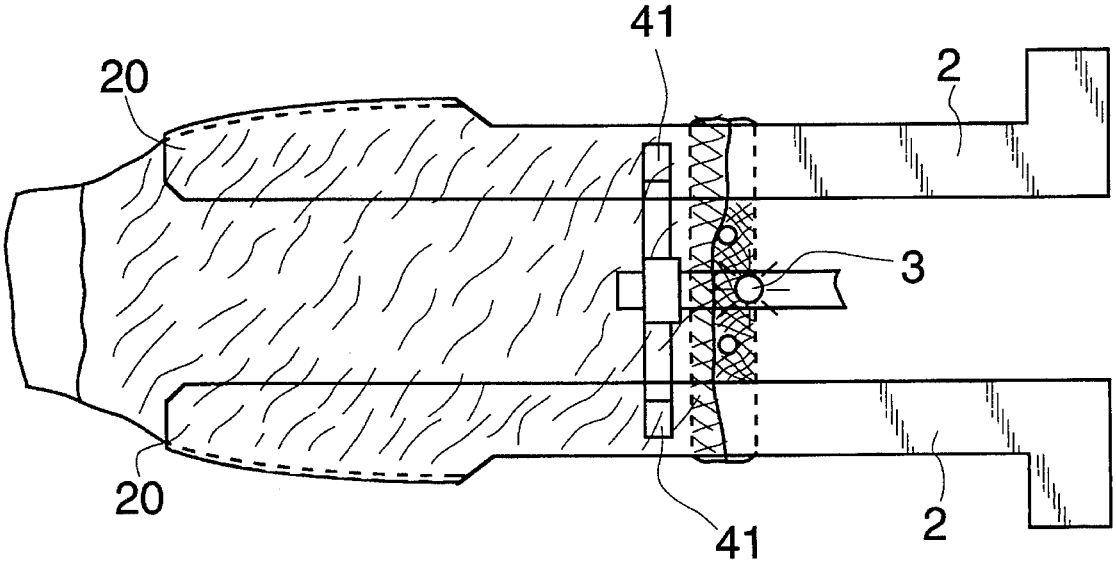
FIG. 4B is the plan view of the apparatus of FIG. 4A.
Figure 4C:
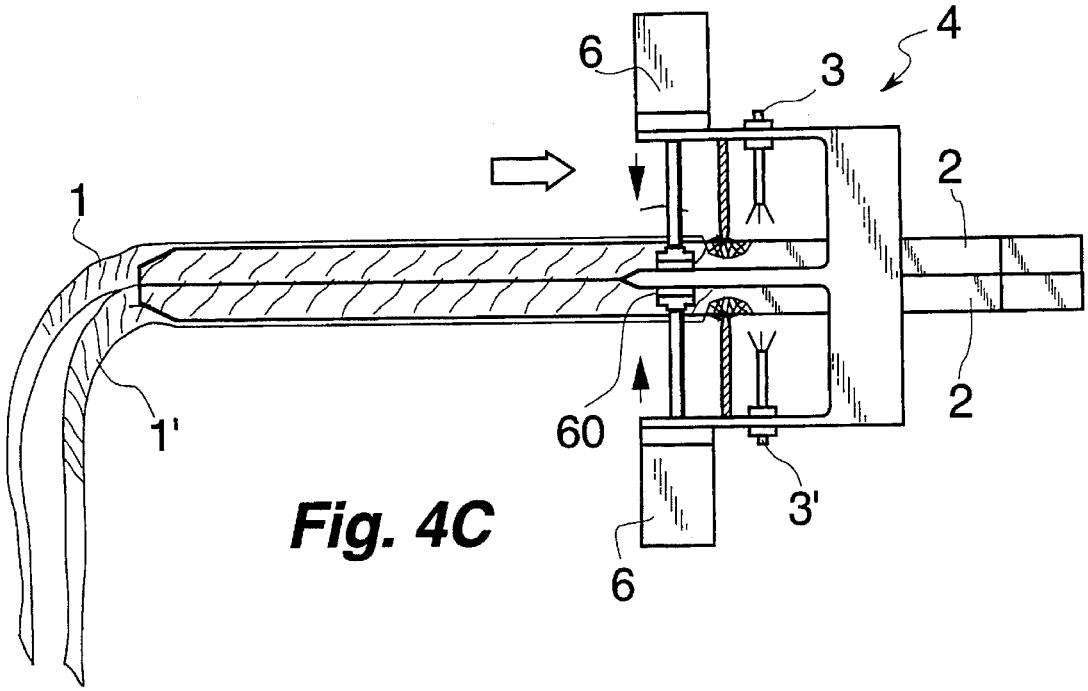
FIG. 4C shows the apparatus of FIG. 1A before leaving the stocking.
Figure 4D:
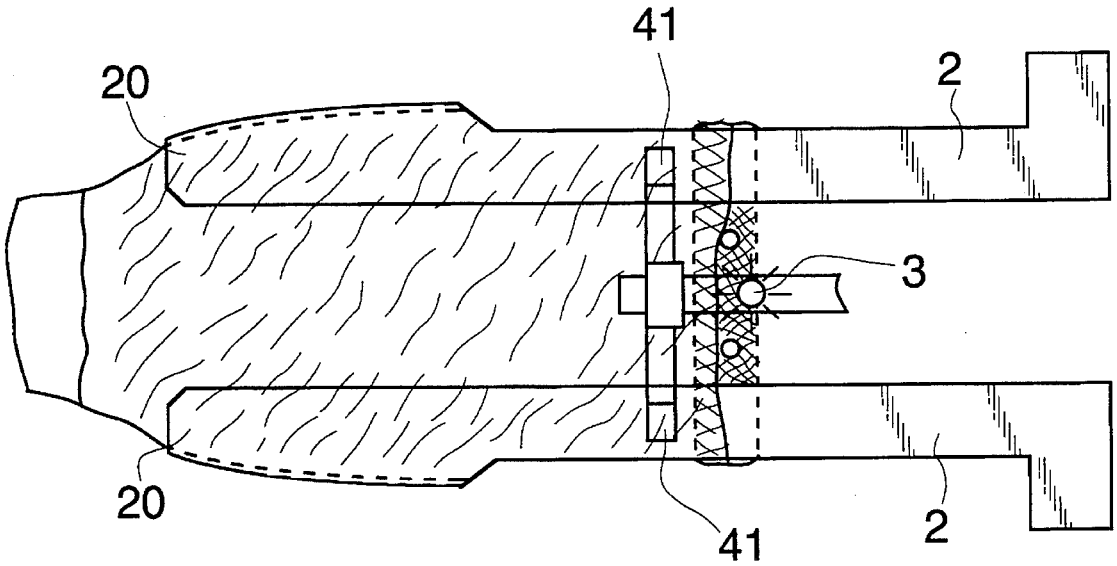
FIG. 4D is the plan view of the apparatus of FIG. 4C.
Figure 5A:
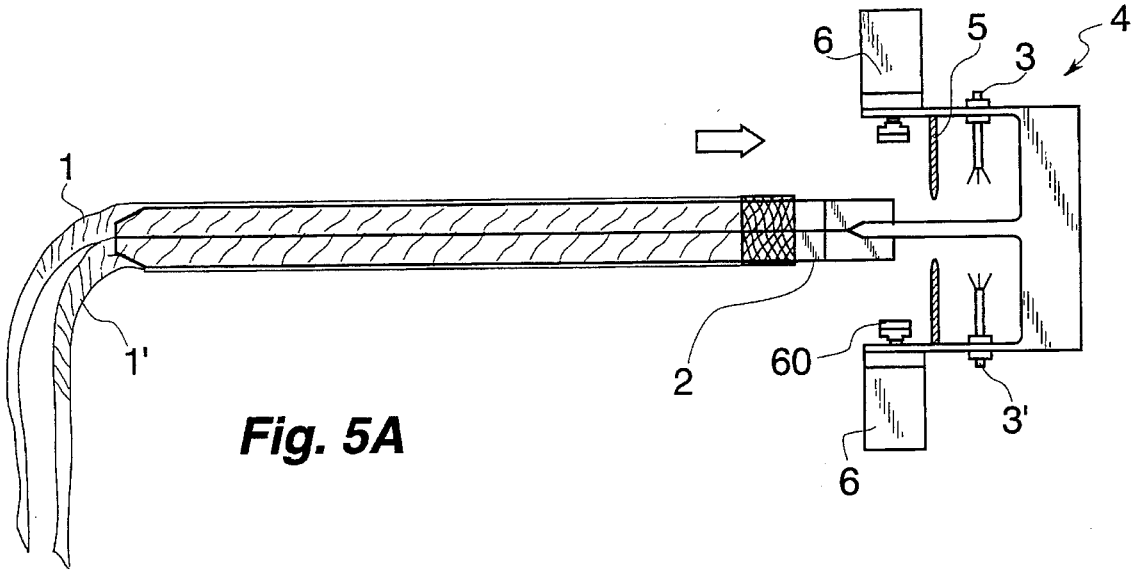
FIG. 5A shows the apparatus of FIG. 1A after having left the elastic hem of the articles in the final predetermined position.
Figure 5B:
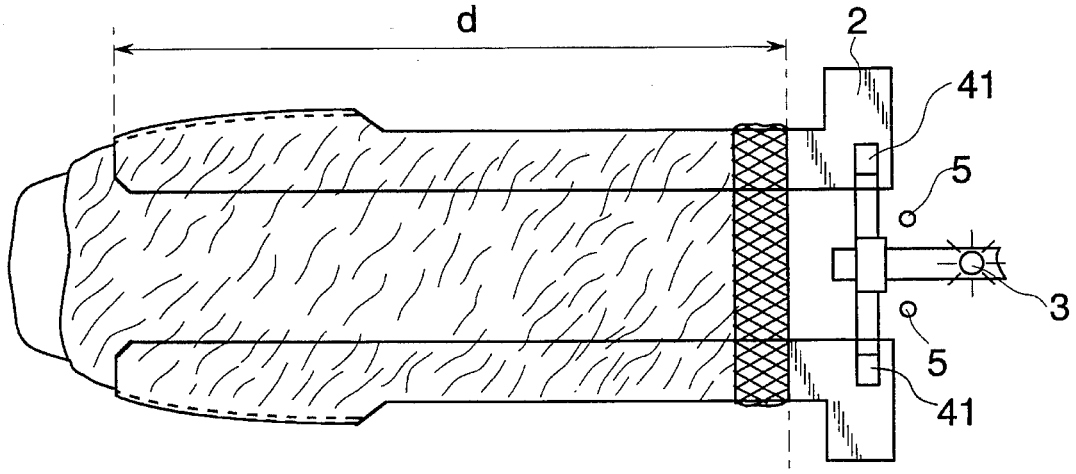
FIG. 5B is the plan view of the apparatus of FIG. 5A.

Advantageously, according to the invention, reference being made to FIGS. 1A–5B of the attached drawings, each of said sensors (3,3') is mounted in a position behind the corresponding pushers (5) with respect to the carriage (4)-feeding direction.

Also advantageously, each pair of pushers (5) is supported by a corresponding bracket located outside the carriage (4).

Figure 6A:
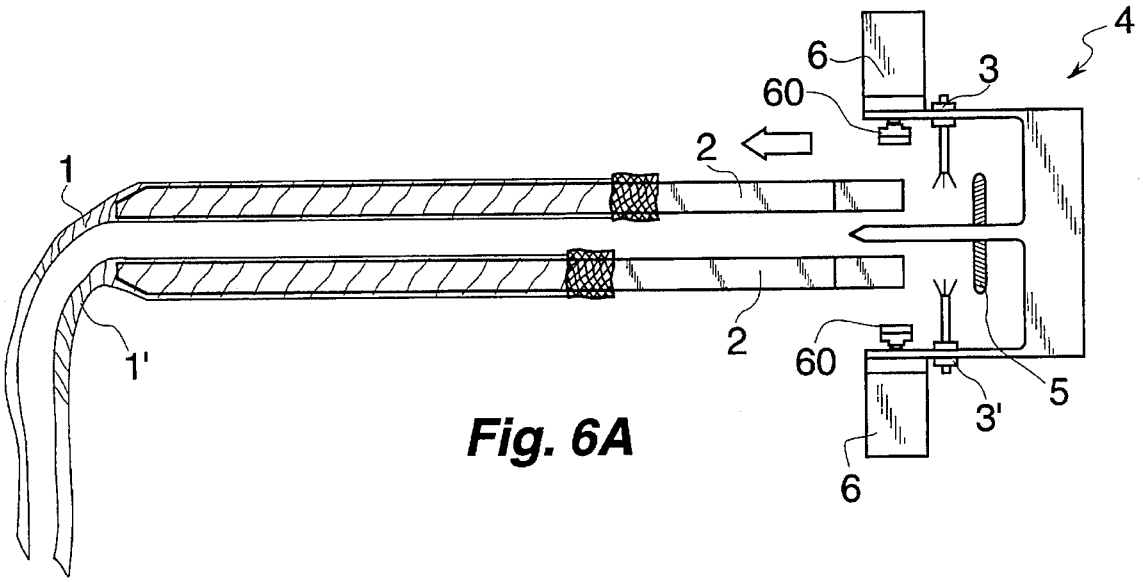
FIG. 6A is a longitudinal section of the apparatus of FIG. 1A, according to an alternative embodiment.
Figure 6B:
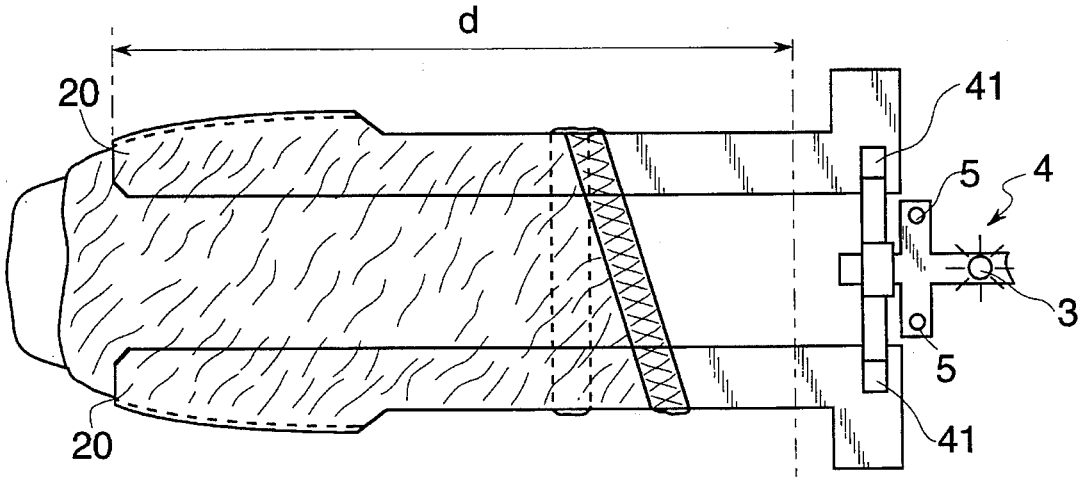
FIG. 6B shows the plan view of the apparatus of FIG. 6A.
Figure 7A:
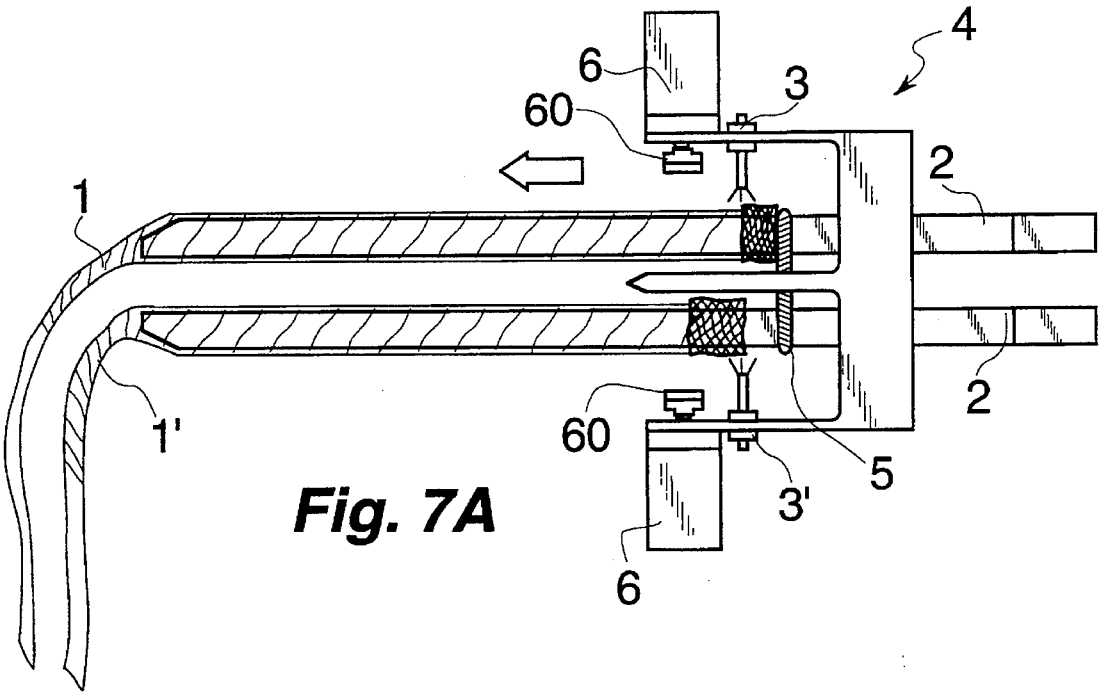
FIG. 7A is a longitudinal section of the apparatus of FIG. 2A, according to an alternative embodiment.
Figure 7B:
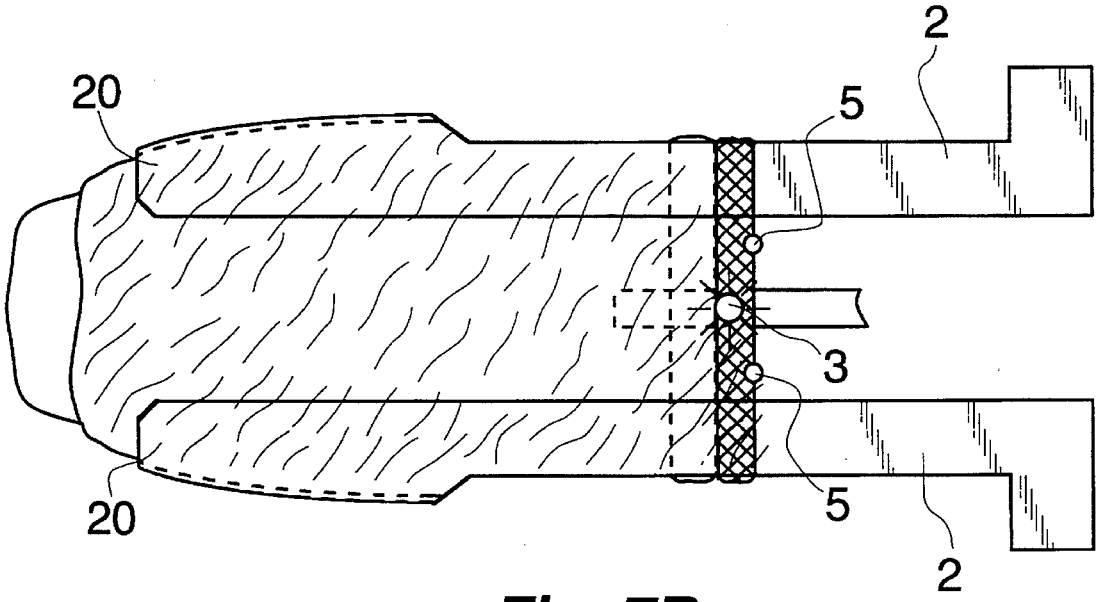
FIG. 7B is the plan view of the apparatus of FIG. 7A.
Figure 8A:
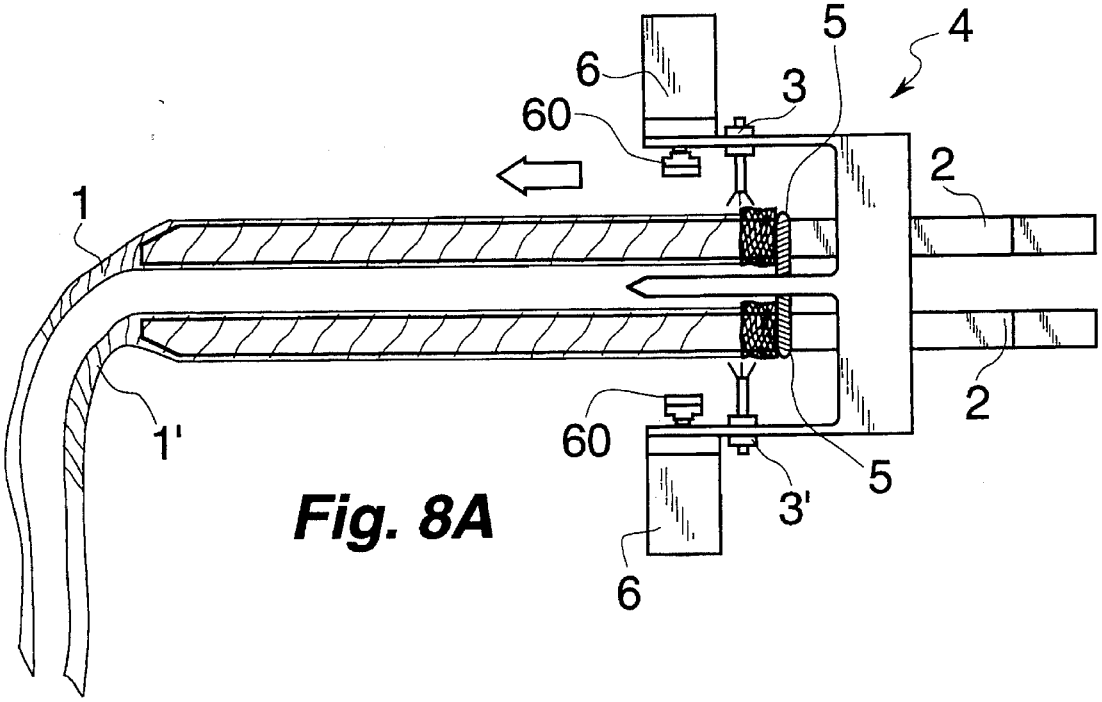
FIG. 8A is a longitudinal section of the apparatus of FIG. 3A, according to an alternative embodiment.
Figure 8B:
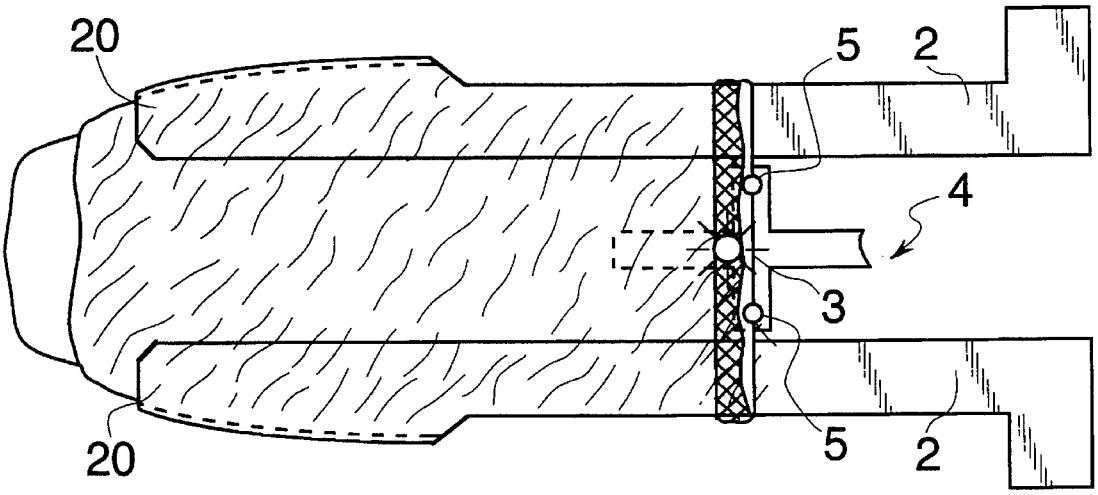
FIG. 8B is the plan view of the apparatus of FIG. 8A.
Figure 9A:
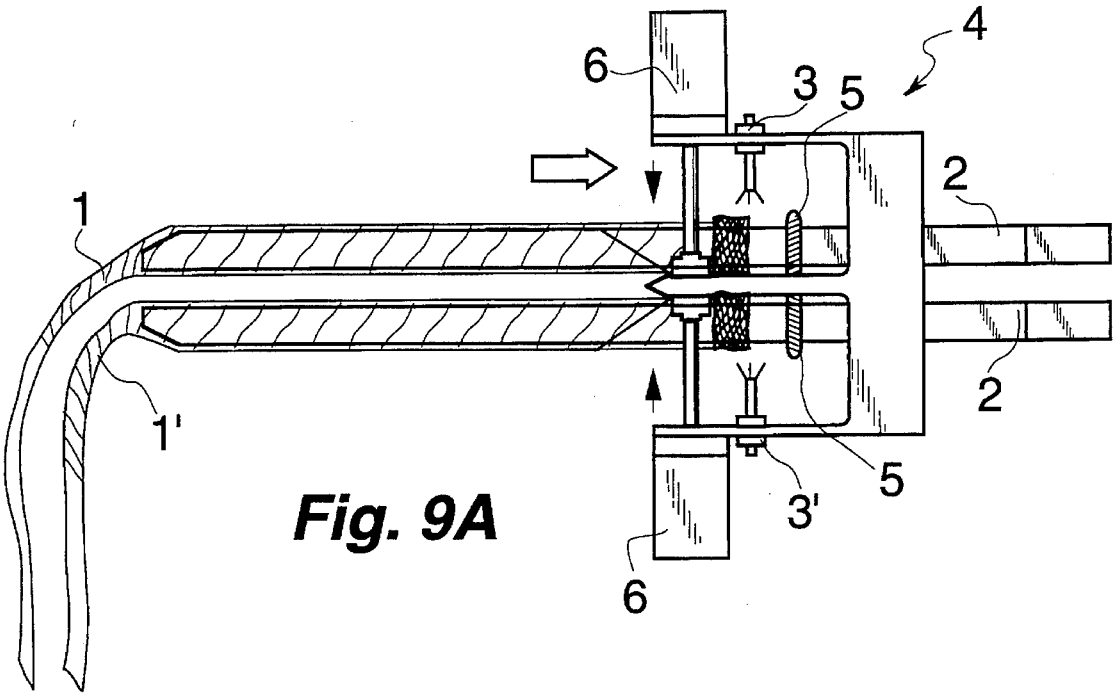
FIG. 9A is a longitudinal section of the apparatus of FIG. 4A, according to an alternative embodiment.
Figure 9B:
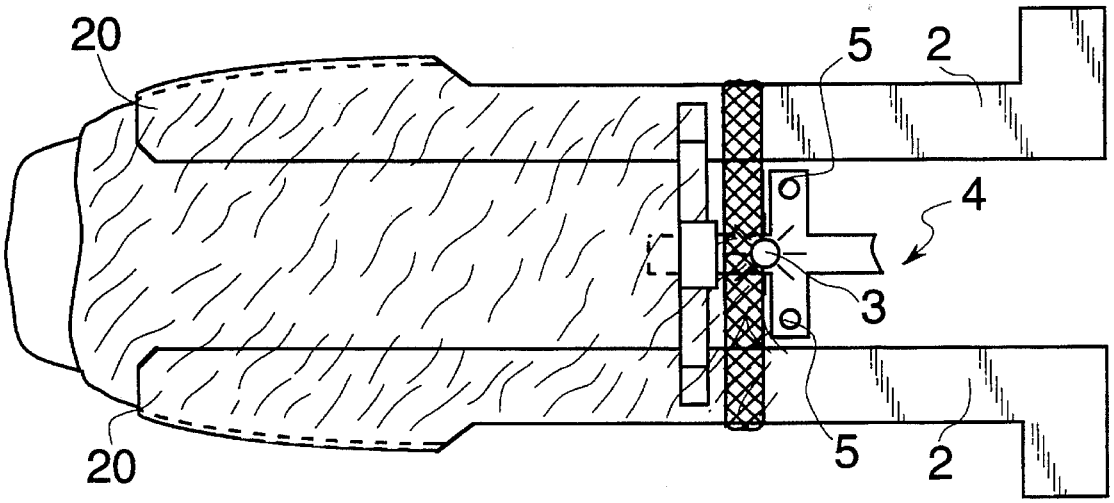
FIG. 9B is the plan view of the apparatus of FIG. 9A.
Figure 9C:
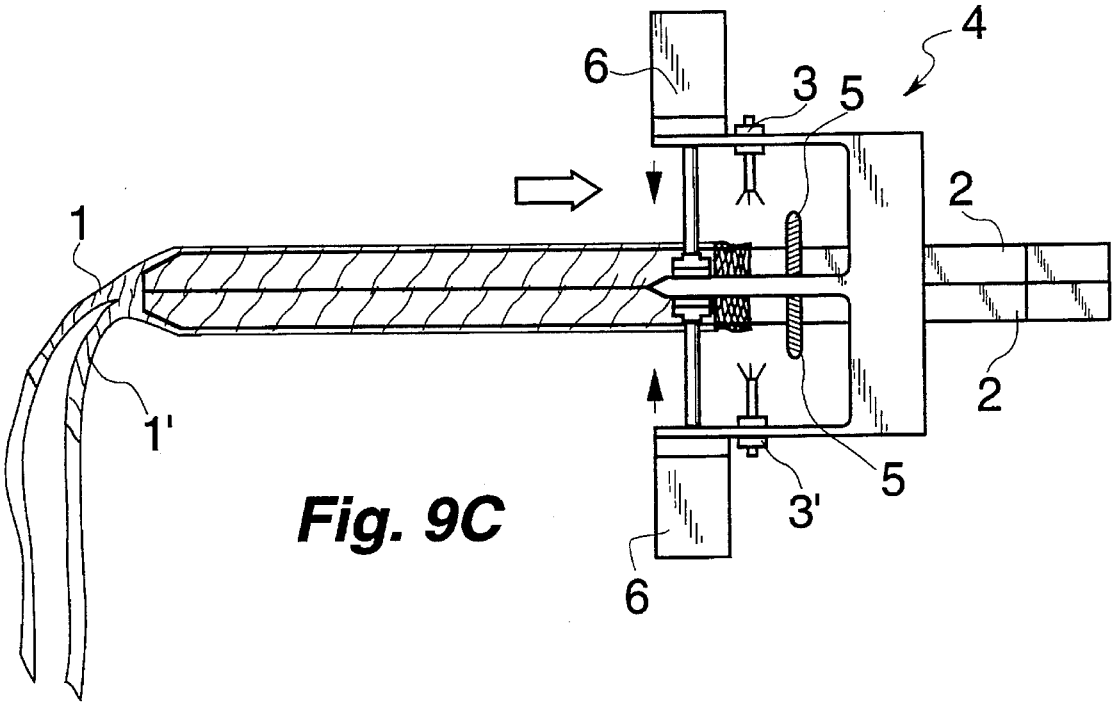
FIG. 9C is a longitudinal section of the apparatus of FIG. 4C, according to an alternative embodiment.
Figure 9D:
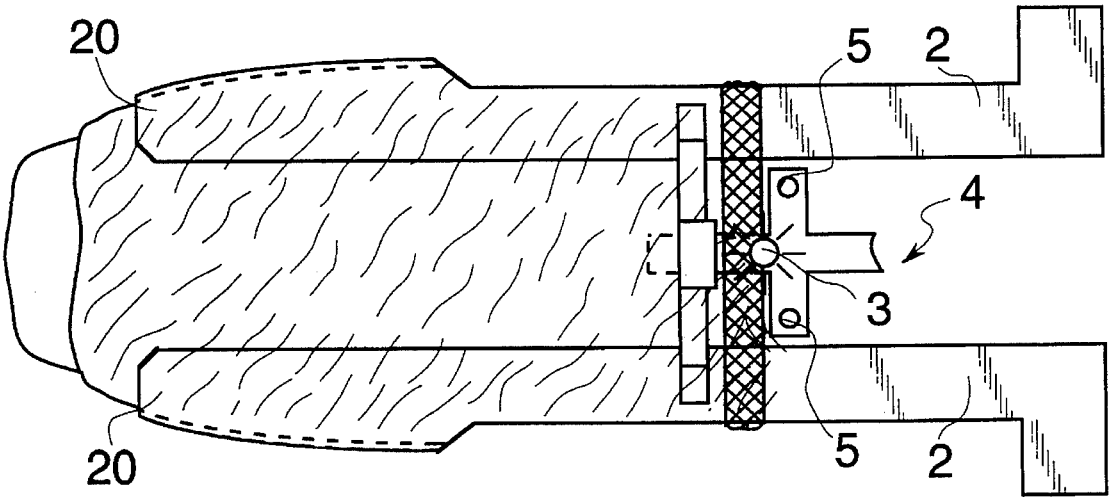
FIG. 9D is the plan view of the apparatus of FIG. C.
Figure 10A:
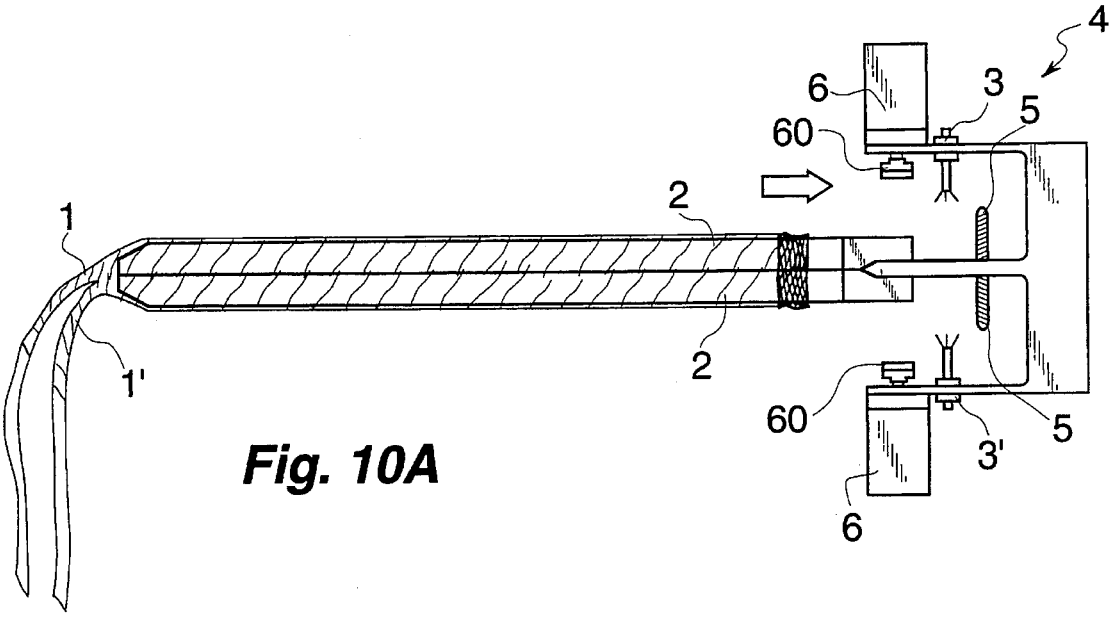
FIG. 10A is the longitudinal section of the apparatus of FIG. 5A, according to an alternative embodiment.
Figure 10B:
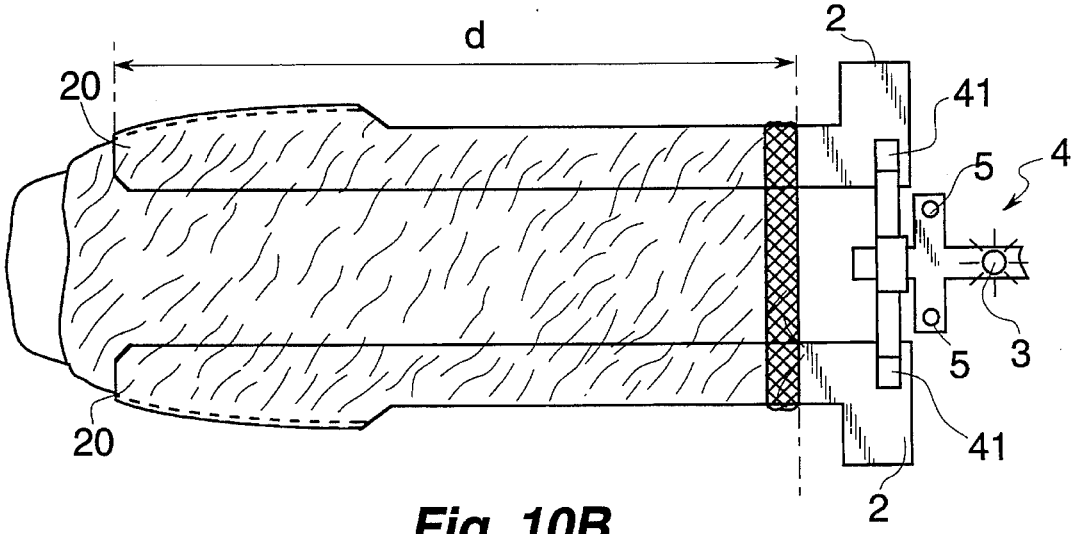
FIG. 10B is the plan view of the apparatus of FIG. 10A.

According to an alternative embodiment of the invention, reference being made to FIGS. 6A–10B of the attached drawings, each of said sensors (3,3–) is mounted in a position before the corresponding pushers (5) with respect to the carriage (4)-feeding direction.

According to said alternative embodiment, the pushers (5) are supported by the central bracket of carriage (4).

Advantageously, according to the invention, the said carriage (4) is provided with means for dissipating the elastic energy built up by the stockings (1,1') during their positioning, with two laminae (41) cooperating with the pads (60) and whose free ends are in contact, during said positioning, with the elastic hem (10,10') of the stockings (1,1') so as to prevent them, upon their release, from moving back elastically to a misalignment position.

The operation of the above described apparatus, reference being made to the embodiment illustrated in FIGS. 1A–5B, is as follows.

After having fitted the two stockings (1,1') at random on the respective support shapes (2), provision is made for driving the carriage (4) forward towards the tip (20) of the shapes (2). Also advancing together with the carriage (4) are the cylinders (6), pushers (5) and sensors (3,3'), as they are all supported by the same carriage. When the tip of pusher (5) comes in contact with the external edge of the elastic hem (10) of the stocking (1) being fitted on the respective shape (2) more deeply than the other stocking (1'), it lifts partially said external edge leaving exposed the internal edge thereby enabling the corresponding sensor (3) to detect the presence thereof. Afterwards, with the further advancement of the carriage (4), the same thing occurs for the other stocking (1'). At this point, the run of carriage (4) is reversed and, when both the sensors (3,3') come out of contact with the respective stockings (1,1'), provision is made for driving the cylinders (6) into operation so that the pads (60) thereof will compress the elastic hems (10,10') of the stockings (1,1') on the respective shapes (2). The further backwards displacement of carriage (4) with the stockings (1,11') thus retained by the cylinders (6), allows the elastic hems (10,10') of said stockings (1,1') to be drawn up to a point a predetermined distance away from the tips (20) of the shapes (2), where they will be clamped by the closing of the shapes (2) and then released with the elastic hems (10,10') thereof in vertical alignment.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

I claim:

1. A method for individually disposing two articles in a predetermined position on corresponding paired support shapes, comprising the steps of:

fitting the two articles substantially at random on the paired support shapes, the shapes being coupled horizontal and superimposed flat shapes, the two articles having a free end with an elastic hem, the random fitting of the articles resulting in a first article being fit further along the fiat shapes than a second article;

pushing the free end of the first article toward an introduction end of the respective shape using pushing means on the outer edge of the elastic hem, in a direction parallel to a longitudinal axis of the shapes to uncover an inner end of the elastic hem of the first article up to a position of vertical alignment of said free ends;

detecting said position of vertical alignment by optical detection means associated with said push means; interrupting an advancement of said push means upon detection of alignment by said optical detection means;

reversing a motion of said pushing means upon interruption of sensing of said elastic hems by said optical means;

compressing and holding said stockings at a location adjacent to said elastic hem; drawing said stockings toward an end of said shapes which is opposite a tip of said shapes, in a direction parallel to an axis of said shapes, up to a predetermined point of said shapes;

moving said shapes into abutting contact to prevent an elastic return of said articles to a position of misalignment; and releasing said articles and maintaining said articles on said support shapes with positioned and aligned free ends.

2. A method according to claim 1, wherein after completing said step of drawing said stockings on said shapes, the elastic hems of said stockings are slightly pushed toward a tip of said respective shapes.

3. An apparatus for disposing two tubular articles in a predetermined position on corresponding paired support shapes, comprising: detection means for detecting an elastic hem end of each article, each article being fitted on a respective support shape, said detection means including two vertically aligned optical sensors located juxtaposed on opposite sides with respect to said shapes with respect to a vertical axial plane of said shapes; alignment means for vertically aligning elastic hems of said articles, said alignment means including two pairs of pushers disposed in side by side relationship along a line orthogonal to an axis of said shapes, said pushers being disposed parallel to corresponding said optical sensors and located on opposite sides with respect to said shapes; compressing and retaining means for compressing and retaining an elastic hem free end of each stocking, said compressing and retaining means comprising two vertically aligned operating cylinders juxtaposed and located on opposite sides of said shapes, each of said cylinders being provided with a pad connected to a free end thereof; movement means for alternately moving said optical sensors, said pushers an said cylinders in either of two longitudinal directions with respect to said shapes, said movement means including a carriage alternately movable in said longitudinal directions, said carriage including a frame with three horizontal brackets, disposed substantially parallel to said shapes, said brackets being vertically spaced apart, said three brackets including two external brackets disposed on opposite sides of said shapes for supporting said members and for detecting and capturing said articles, said internal bracket being at a position intermediate said shapes, said carriage being located on a side of said shapes which is opposite a tip end of said shapes.

4. An apparatus according to claim 3, wherein said optical sensors are mounted on said carriage disposed behind said pushers with respect to a tip direction movement of said carriage.

5. An apparatus according to claim 3, wherein said pushers are supported by a corresponding bracket located externally of said carriage.

6. An apparatus according to claim 3, wherein each of said optical sensors is mounted in a position in front of a corresponding pusher with respect to a tip direction of advancement of said carriage.

7. An apparatus according to claim 3, wherein said pushers are supported by said central bracket of said carriage.

8. An apparatus according to claim 3, wherein said carriage is provided with means for dissipating elastic energy accumulated by said stockings during positioning, said means for dissipating elastic energy including two laminae cooperating with pads of said cylinders, said laminae having free ends in contact with said elastic hem, during said positioning, of said stockings so as to prevent said stockings from elastically moving to a misalignment position upon their release.

9. A method for individually disposing two stockings in a predetermined position on corresponding paired support shapes, comprising the steps of:

fitting the two stockings substantially at random on the paired support shapes, the shapes being coupled horizontal and superimposed flat shapes, the two stockings having a free end with an elastic hem, the random fitting of the stockings resulting in a first stocking being fit further along the fiat shapes than a second stocking;

pushing the free end of the first stocking toward an introduction end of the respective shape using pushing means on the outer edge of the elastic hem, in a direction parallel to a longitudinal axis of the shapes to uncover an inner end of the elastic hem of the first stocking up to a position of vertical alignment of said free ends;

detecting said position of vertical alignment by optical detection means associated with said push means; interrupting an advancement of said push means upon detection of alignment by said optical detection means;

reversing a motion of said pushing means upon interruption of sensing of said elastic hems by said optical means;

compressing and holding said stockings at a location adjacent to said elastic hem; drawing said stockings toward an end of said shapes which is opposite a tip of said shapes, in a direction parallel to an axis of said shapes, up to a predetermined point of said shapes;

moving said shapes into abutting contact to prevent an elastic return of said stockings to a position of misalignment; and releasing said stockings and maintaining said stockings on said support shapes with positioned and aligned free ends.

10. A method according to claim 1, wherein after completing said step of drawing said stockings on said shapes, the elastic hems of said stockings are slightly pushed toward a tip of said respective shapes.

* * * * *

UNITED STATES PATENT AND TRADEMARK OFFICE

CERTIFICATE OF CORRECTION

PATENT NO. : 5,505,350
DATED : April 9, 1996
INVENTOR(S) : Migliorini

It is certified that error appears in the above-identified patent and that said Letters Patent is hereby corrected as shown below:

On the title page, item [75] Inventor: "Pier L. Migliorini" should read -- Pier Lorenzo Migliorini--.

Signed and Sealed this

Sixth Day of August, 1996

*Attest:*

*Attesting Officer*

BRUCE LEHMAN

*Commissioner of Patents and Trademarks*